US009737931B2

(12) United States Patent
Doi et al.

(10) Patent No.: US 9,737,931 B2
(45) Date of Patent: Aug. 22, 2017

(54) METHOD FOR PRODUCING PLATINUM GROUP ALLOY

(71) Applicant: ISHIFUKU Metal Industry Co., Ltd., Tokyo (JP)

(72) Inventors: Yoshinori Doi, Soka (JP); Daisuke Kon, Soka (JP)

(73) Assignee: ISHIFUKU METAL INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 15/307,138

(22) PCT Filed: Mar. 27, 2015

(86) PCT No.: PCT/JP2015/059700

§ 371 (c)(1),
(2) Date: Oct. 27, 2016

(87) PCT Pub. No.: WO2016/038915

PCT Pub. Date: Mar. 17, 2016

(65) Prior Publication Data

US 2017/0043393 A1 Feb. 16, 2017

(30) Foreign Application Priority Data

Sep. 10, 2014 (JP) ..... 2014-184677

(51) Int. Cl.
*B22D 11/041* (2006.01)
*B22D 27/02* (2006.01)
*B22D 11/18* (2006.01)

(52) U.S. Cl.
CPC ..... *B22D 11/18* (2013.01); *B22D 11/041* (2013.01); *B22D 27/02* (2013.01)

(58) Field of Classification Search
CPC ..... B22D 11/00; B22D 11/001; B22D 11/041; B22D 11/18; B22D 27/02
(Continued)

(56) References Cited

U.S. PATENT DOCUMENTS 3,894,573 A * 7/1975 Paton ..... H05B 7/00 164/469
6,019,812 A * 2/2000 Volas ..... C22B 9/226 164/494
6,868,896 B2 * 3/2005 Jackson ..... B22D 11/001 164/514

FOREIGN PATENT DOCUMENTS

JP 10280070 A 10/1998
JP 11061392 A 3/1999
JP 2011179025 A 9/2011

* cited by examiner

*Primary Examiner* — Kevin E Yoon
(74) *Attorney, Agent, or Firm* — Browdy and Neimark, PLLC

(57) ABSTRACT

Provided is a method for producing a platinum group-based alloy capable of producing a sound molten ingot of a platinum group-based alloy in a large amount. The method for producing a platinum group-based alloy includes a molten ingot production step of a continuous casting system using a plasma arc melting furnace configured to form a plasma arc column between an electrode torch which is arranged in an upper part of a vacuum chamber and a water cooled copper crucible which is arranged in a lower part of the chamber and has a cavity having a sectional area S1, the molten ingot production step including: inserting and melting an end part of a raw material bar including a platinum group-based alloy in the plasma arc column to cause the raw material bar to fall in drops on a base material in the water cooled copper crucible, to thereby form a molten pool; and solidifying a bottom part of the molten pool while maintaining a constant liquid level height of the molten pool by pulling down the base material, the molten ingot having a horizontal sectional area S ($mm^2$) and a length L (mm) satisfying the following relationship: $S1 \geq S > 500$, $L > 4\sqrt{(S/\pi)}$, an internal pressure of the chamber during melting being 0.8
(Continued)

atm or more, a pulling down speed of the base material being 10 mm/min or less.

2 Claims, 2 Drawing Sheets

(58) Field of Classification Search
USPC ..... 164/469, 475, 508
See application file for complete search history.

METHOD FOR PRODUCING PLATINUM GROUP ALLOY

TECHNICAL FIELD

The present invention relates to a method for producing a platinum group-based alloy, and more particularly, to production of a molten ingot in a method for producing a platinum group-based alloy.

BACKGROUND ART

A platinum group-based alloy is designed using heat resistance, oxidation resistance, and chemical resistance of a platinum group metal, and is widely used as a high-temperature member or a corrosion-resistant product. The platinum group metal as used herein collectively refers to Pt, Pd, Rh, Ir, Ru, and Os.

Processes for production of a platinum group-based alloy generally include a compounding step, a melting step, a plastic working step, and the like for an alloy raw material. The melting method can be classified into several types. A platinum group metal, which is a main component of the platinum group-based alloy, has a very high melting point, and hence an induction heating melting furnace or an energy beam melting furnace is used.

The mainstream of induction heating melting has been a melting method involving using an oxide-based refractory crucible in a vacuum or an inert gas, while a cold crucible has recently been tried out (for example, Patent Literature 1).

Non-consumable electrode-type arc melting, consumable electrode-type arc melting, vacuum plasma melting, electron beam melting, and the like have been applied to energy beam melting, and the mainstream is the non-consumable electrode-type arc melting (for example, Patent Literature 2). The non-consumable electrode-type arc melting is a method involving forming an arc column between a W (tungsten) electrode having a sharply polished discharge end and an alloy raw material placed on a boat-shaped water cooled copper crucible, and melting the alloy raw material through use of the arc column as a heat source. The consumable electrode-type arc melting is a melting method involving using, as an electrode, a raw material itself, and forming an arc column between an end of the electrode and a water cooled copper crucible. By virtue of a melting ability of several hundred kilograms, the consumable electrode-type arc melting is used for production of a non-noble metal, such as Ti, but is not used for melting of the platinum group-based alloy. The vacuum plasma melting and the electron beam melting have a refining action because of melting in a vacuum or a high vacuum, and in addition, are suited for mass melting because a beam having a high energy density is used (for example, Patent Literature 3).

In the induction heating melting, a molten ingot is generally produced by melting an alloy raw material in a refractory crucible and inclining the crucible to pour and cast the alloy raw material into a casting mold. The refractory crucible has a temperature limit, and is used for production of a platinum group-based alloy having a relatively low melting point (roughly 2,000° C. or less). This method has an advantage of being capable of producing several ten kilograms of the molten ingot in a short time, but entails a risk of inclusion of refractory owing to inevitable contact between the refractory crucible and a molten metal, sometimes resulting in mixing of the refractory in the molten ingot. In addition, this method also generates casting defects, such as a shrinkage cavity, pores, and casting surface roughness, and has a problem of a low material yield owing to the need for removal processing of defect portions, such as cutting, trimming, or grinding.

In the non-consumable electrode-type arc melting, the discharge end of the W electrode gradually wears in a long melting time (arcing time), and melting cannot be continued owing to stop or wandering of the arc column. Therefore, a melting operation needs to be interrupted and the discharge end of the W electrode needs to be re-polished. In addition, in combination with a relatively small irradiation area of the arc column, continuous casting cannot be performed. That is, productivity is poor, and the amount of the alloy meltable at one time is limited to about several kilograms. In addition, it is general to reduce pressure to less than 0.8 atm during melting. When an alloy containing component elements having largely different vapor pressures is melted, a component element having a higher vapor pressure vaporizes more and an alloy composition varies.

The vacuum plasma melting and the electron beam melting generally have the ability to continuously cast an alloy in a large amount as compared to the non-consumable electrode-type arc melting, and are suitable for melting of a pure metal because impurities can be vaporized and removed (refining effect) by virtue of a vacuum melting atmosphere. However, in melting of the alloy, a component element having a higher vapor pressure vaporizes more and an alloy composition varies.

As described above, the melting methods, which have hitherto been widely used, have their limits in producing the platinum group-based alloy without a compositional variation in a large amount at high yield.

CITATION LIST

Patent Literature

[PTL 1] JP 10-280070 A
[PTL 2] JP 2011-179025 A
[PTL 3] JP 11-61392 A

SUMMARY OF INVENTION

Technical Problem

The present invention has been made in view of the problems of the related art described above, and an object of the present invention is to provide a method for producing a platinum group-based alloy capable of producing a sound molten ingot of a platinum group-based alloy in a large amount.

Solution to Problem

First Embodiment of Present Invention

According to a first embodiment of the present invention, there is provided a method for producing a platinum group-based alloy, the method including a molten ingot production step of a continuous casting system using a plasma arc melting furnace configured to form a plasma arc column between an electrode torch (hereinafter referred to as plasma torch) which is arranged in an upper part of a vacuum chamber and a water cooled copper crucible which is arranged in a lower part of the chamber and has a cavity having a sectional area S1, the molten ingot production step including:

inserting and melting an end part of a raw material bar including a platinum group-based alloy in the plasma arc column to cause the raw material bar to fall in drops on a base material in the water cooled copper crucible, to thereby form a molten pool; and solidifying a bottom part of the molten pool while maintaining a constant liquid level height of the molten pool by pulling down the base material, the molten ingot having a horizontal sectional area S and a length L satisfying the following relationship:

$$S1 \geq S > 500\ (\mathrm{mm}^2),\ L > 4\sqrt{(S/\pi)}\ (\mathrm{mm}),$$

an internal pressure of the chamber during melting being 0.8 atm or more, a pulling down speed of the base material being 10 mm/min or less.

Herein, the sectional area S is an important melting parameter. When the sectional area S is less than 500 $mm^2$, the volume of the molten pool is reduced relative to its contact area with the water cooled copper crucible. That is, internal energy for maintaining melting runs short, with the result that the molten pool is liable to be solidified and cannot maintain a uniformly molten and solidified state. Therefore, a casting surface of the molten ingot becomes remarkably rough. The sectional area S is generally equal to or less than the sectional area S1 of the cavity because of solidification shrinkage. The shape of the cavity may be selected appropriately, but a circle shape, a substantially square shape, and a substantially polygonal shape are suitable in order to maintain a more uniformly molten and solidified state.

Meanwhile, a platinum group metal, which is a main component of the platinum group-based alloy, has a melting point as high as 1,500° C. or more and a remarkably high constant volume latent heat as compared to other high-melting-point metals. Therefore, it is particularly difficult to maintain the molten pool in a uniformly molten state. Herein, the constant volume latent heat ($kJ/cm^3$) refers to a latent heat required for a substance per unit volume to be fused and is defined by its heat of fusion (kJ/mol), molar mass (g/mol), and density ($g/cm^3$). That is, when the platinum group metal (for example, Ir) is fused, it is necessary to continuously supply a double heat amount as compared to the other high-melting-point metals having the same volume and a similar melting point (for example, Nb) (FIG. 1). Herein, in FIG. 1, relationships between constant volume latent heats and melting points of the platinum group metals and high-melting-point metals other than the platinum group are shown. Accordingly, when heat input from the plasma arc column is reduced, internal energy for maintaining melting immediately runs short, with the result that the molten pool is liable to be solidified. It is difficult to maintain a uniformly molten and solidified state as compared to the other high-melting-point metals, and a sound molten ingot having a smooth casting surface, that is, without casting defects cannot be obtained.

The inventors of the present invention have addressed the problem, and as a result, have found that, when the internal pressure of the chamber is set to 0.8 atm or more, the molten ingot having a sectional area S of 500 $mm^2$ or more with less casting surface roughness can be produced. In a plasma arc melting method, the plasma arc column is formed in an electric field between the electrode torch and the molten pool. When a gas density in the electric field is high, a voltage of the plasma arc column is increased and concurrently the plasma arc column is narrowed because of a magnetic pinch effect, with the result that an energy density can be increased more. As a result, even the molten pool of the present invention having a small area (500 $mm^2$) can maintain a uniformly molten and solidified state. Accordingly, when the internal pressure of the chamber is less than 0.8 atm, such effect is small, the casting surface of the molten ingot becomes remarkable rough even when the sectional area S is 500 $mm^2$, and the object cannot be achieved.

Melting may be performed by fixing the electrode torch or by causing a tip portion of an external cylinder of the electrode torch to gyrate at an appropriate gyration radius so that a uniformly molten and solidified state is maintained. When the tip portion of the external cylinder of the electrode torch is caused to gyrate, the plasma arc column gyrates on the entirety of the molten pool. Therefore, particularly when the S1 is large, the gyration is useful because a heating effect on the entirety of the molten pool is increased and a stirring effect of an eddy current on the molten pool is increased.

When the plasma arc melting furnace having the configurations and the conditions described herein are applied, continuous casting can be performed, and hence the long molten ingot having the sectional area S and the length L is obtained. The limit of the length L is not particularly limited because the limit depends on a pulling down allowance of a facility, but a length of 500 mm or more can be achieved. It should be noted that, in view of the object of the present invention, the case of $L<4\sqrt{(S/\pi)}$ is omitted because even other related art, for example, a non-consumable electrode-type arc melting furnace is sufficiently applicable to such case.

In addition, while an atmosphere gas may be appropriately selected and is generally set to Ar, also He, $N_2$, $H_2$, $CO_2$, or the like may be used in combination for the purpose of attaining an increase in voltage or a reducing atmosphere. When the internal pressure of the chamber is set to the atmospheric pressure (1 atm) or more duringmelting, vaporization of alloy elements is effectively suppressed. The component elements constituting the alloy have vapor pressures specific to the elements under the same temperature and pressure (for example, detailed on page 406 of Metals Data Book, fourth revised edition, edited by The Japan Institute of Metals and Materials). When the alloy is heated, the component elements vaporize in accordance with their vapor pressures. Therefore, a component element having a high vapor pressure (susceptible to vaporization) is reduced in the composition of the molten ingot, and the composition of the molten ingot deviates from the composition before melting (compositional variation), which causes a problem in that a target composition is not obtained. Besides, a reduction in yield is caused by a reduced component.

The plasma arc melting furnace to be used in the present invention has configurations entirely different from those of a vacuum plasma melting furnace, and in particular, has a different action on the compositional variation. The vacuum plasma melting furnace has a structure in which a plasma beam is formed by thermionic emission from a hollow cathode (cylindrical) made of Ta and a trace amount of a plasma source gas (generally, Ar) emitted from the hollow electrode, and the plasma beam is narrowed by a high-frequency focusing coil arranged around the plasma beam to increase an energy density. The plasma beam at high temperature and high energy density is formed between a tip of the hollow cathode and a water cooled copper crucible, and fuses a melting raw material present in an irradiation area to form a molten pool. The internal pressure of a chamber during melting needs to be set to a vacuum of about 1 Pa by precisely controlling the flow rate of the plasma source gas and a discharge gas velocity.

Accordingly, in the vacuum plasma melting furnace, melting needs to be performed in a vacuum, and hence an alloy composition largely varies. Meanwhile, in the plasma arc melting of the present invention, melting is performed at a chamber internal pressure of 0.8 atm or more, and hence the compositional variation can be effectively suppressed.

Also the pulling down speed is an important parameter. When the pulling down speed is more than 10 mm/min, heating and cooling are unbalanced, the molten pool is liable to be solidified, and the casting surface becomes remarkably rough. No inconvenience is caused on a low speed side, but a speed lower than necessary reduces productivity. A pulling down speed of from 1 mm/min to 4 mm/min is more preferably suitable.

Second Embodiment of Present Invention

According to a second embodiment of the present invention, which is related to the first embodiment of the present invention, there is provided a method for producing a platinum group-based alloy, in which:

the platinum group-based alloy contains 50 mass % or more of any one or more kinds of platinum group metals (Pt, Pd, Rh, Ir, Ru, Os) and 0.5 mass % or less of inevitable impurities; and a difference between maximum and minimum values of vapor pressures of component elements other than the inevitable impurities of the platinum group-based alloy is 0.1 Pa or more at a melting point of a component element having the highest melting point of the component elements.

Herein, the inevitable impurities refer to impurities inevitably contained in a raw material, and the platinum group metal may contain 0.5 mass % or less of another platinum group metal.

In the case of the alloy in which the difference in vapor pressure between the component elements is 0.1 Pa or more, an effect of suppressing vaporization of the alloy elements exhibited by the first embodiment of the present invention is particularly high, and the compositional variation can be effectively suppressed.

Advantageous Effects of Invention

As described above, according to the present invention, the molten ingot having a small alloy compositional variation, no defects, and a smooth casting surface can be mass-produced as compared to the related-art production methods. The small compositional variation eliminates the need for addition of an extra vaporization component in a compounding step, and in addition, largely contributes to quality control because generation of a non-conforming product owing to deviation from a target composition range can be prevented. The molten ingot having no defect and a smooth casting surface enables minimum removal processing in a subsequent step and can suppress a reduction in material yield. In addition, when the long ingot can be mass-produced by the continuous casting system as in the present invention, the productivity is largely increased as a matter of course. In production of the highly expensive platinum group-based alloy, an increase in material yield is a critical issue, and the production method for the present invention contributes to a significant reduction of economic loss.

In addition, according to the present invention, the plasma arc column having a high energy density can be thinly narrowed, and hence the thin molten ingot having a sectional area of 500 $mm^2$ or more is obtained despite the fact that the platinum group-based alloy has a significantly high constant volume latent heat. With this, when the molten ingot is processed into a band, a rod, or a line, also the number of processing steps can be significantly reduced. Accordingly, when the molten ingot produced by the present invention is processed and used for a high-temperature member or a corrosion-resistant product, also a reduction in production cost of a final product can be achieved.

DESCRIPTION OF EMBODIMENTS

The present invention relates to a method for producing a platinum group-based alloy involving producing an ingot by a continuous casting system. Herein, production steps for an iridium alloy electrode tip in a spark plug for an internal combustion engine are described as an example.

(Compounding Step)

Raw material powders of Ir, Rh, and the like are weighed at a predetermined ratio and mixed with a V-type mixer to produce mixed powder (Ir powder: 50 mass % or more). A mixing method is not necessarily limited to a method involving using the V-type mixer, and a method which enables sufficiently uniform mixing of the powders is acceptable.

(Raw Material Bar Production Step)

The mixed powder is formed into a rectangular parallelepiped of 20 mm×20 mm with an automatic press forming machine (uniaxial pressure forming). Other than the above, a method for filling and sealing the mixed powder in a rubber hose or the like, followed by forming into a bar-shaped formed article by CIP may be adopted.

The formed article is sintered at 1,300° C. in a vacuum or an inert atmosphere. A sintered article shrinks through sintering to about 17 mm×17 mm. A plurality of sintered articles are joined by TIG welding, arc welding, or the like to produce a raw material bar.

Other than the above, the raw material bar may be produced by energy beam melting. One or a plurality of formed articles are placed on a water cooled copper crucible having a long and thin boat-shaped cavity, and subjected to energy beam melting. A molten ingot produced through the energy beam melting has a long and thin shape approximately close to the shape of the cavity, and is usable as the raw material bar.

The maximum diameter of a sectional surface of the raw material bar perpendicular to its axis in a longitudinal direction is preferably smaller than the maximum diameter of the cavity of the water cooled copper crucible, and is more preferably not more than half of the maximum diameter of the cavity.

(Melting Step)

Figure 1:
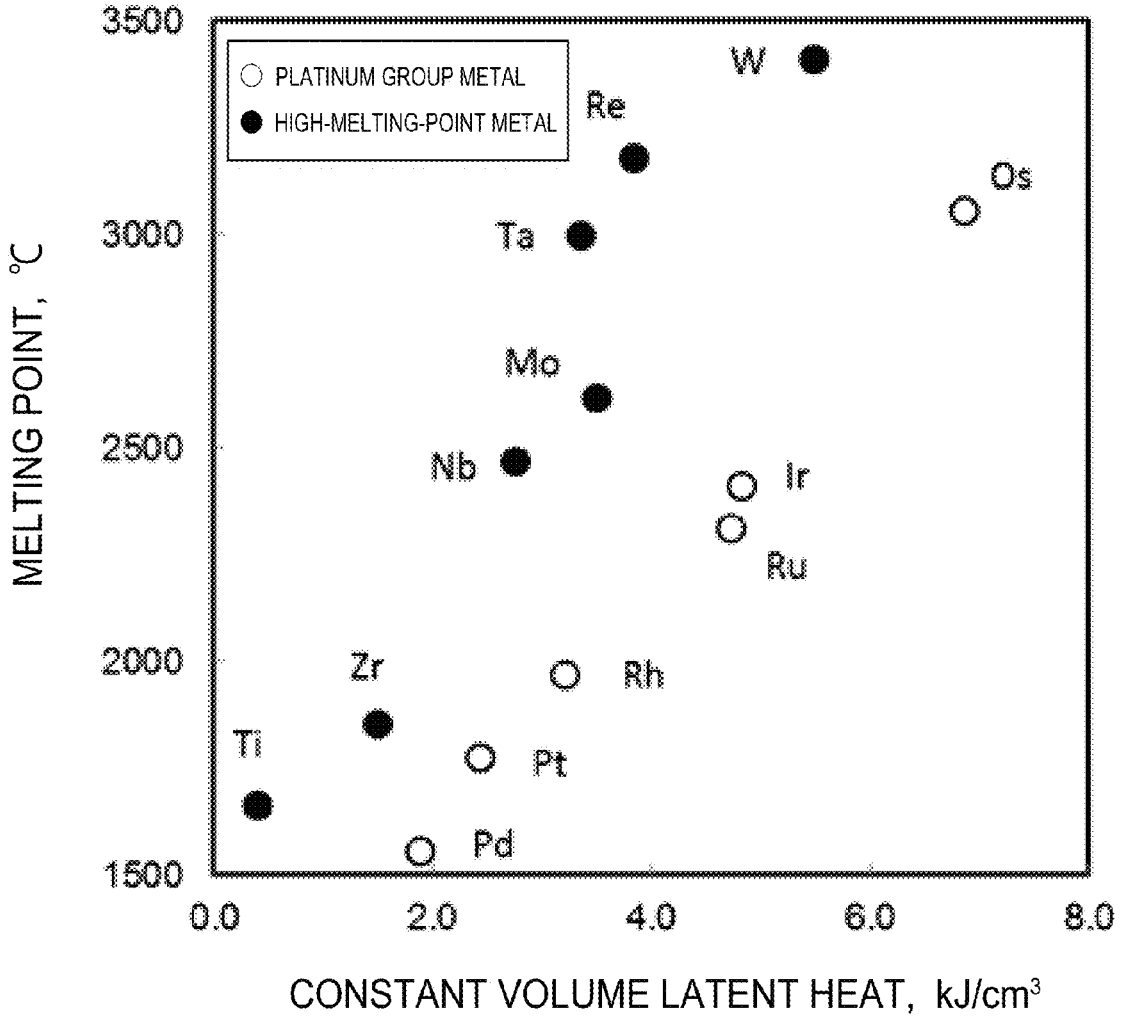
FIG. 1 is a graph for showing constant volume latent heats of platinum group metals and high-melting-point metals other than the platinum group metals.
Figure 2:
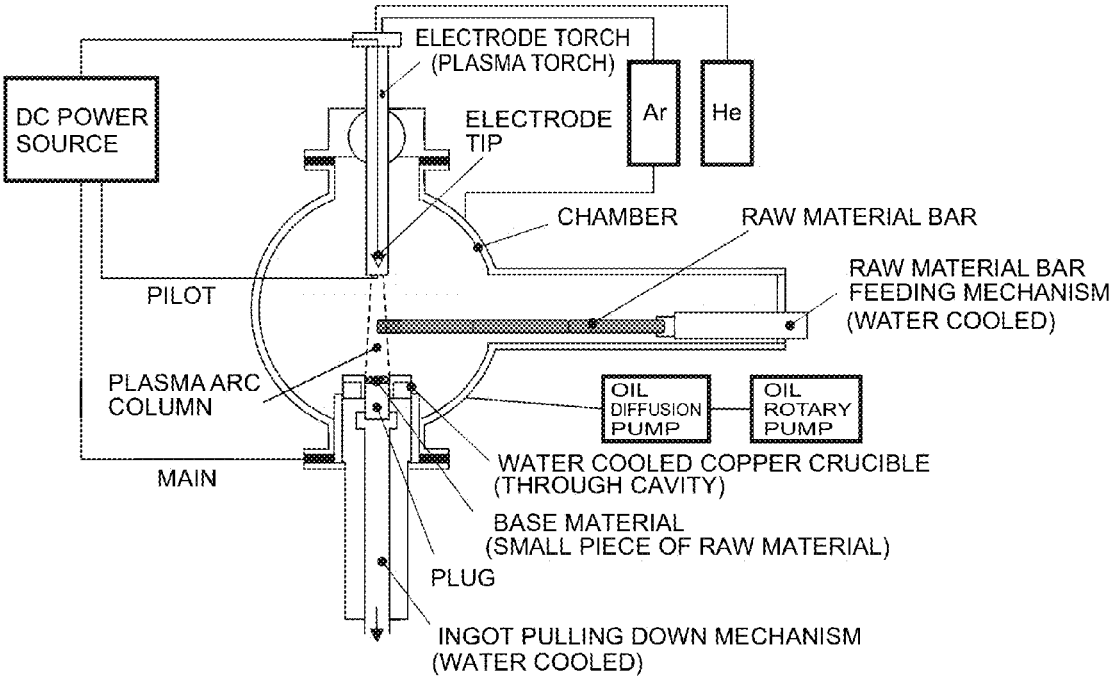
FIG. 2 is a schematic view of a plasma arc melting furnace.
Figure 3:
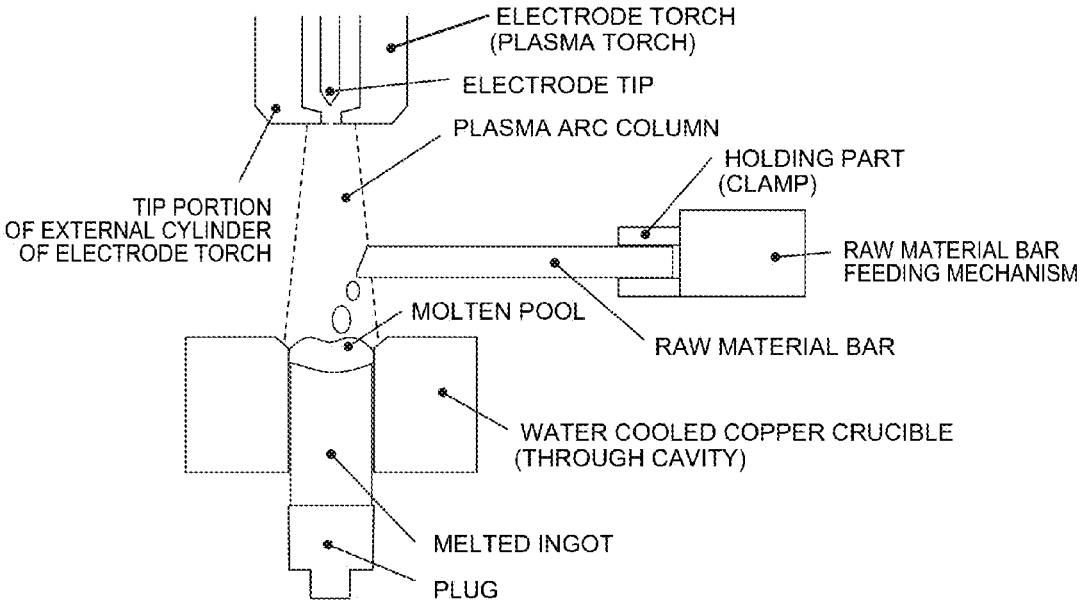
FIG. 3 is a schematic view of pulling down melting.

FIG. 2 is a schematic view of a plasma arc melting furnace. FIG. 3 is a schematic view of pulling down melting. As illustrated in FIG. 2 and FIG. 3, the produced raw material bar is held by a raw material bar feeding mechanism. Specifically, the raw material bar is held by a holding part (clamp) of the raw material bar feeding mechanism. In addition, as illustrated in FIG. 2, a base material (small piece of a raw material) having the same composition as the raw material bar is placed on a plug arranged at a bottom part of the water cooled copper crucible (through cavity). A chamber is vacuum evacuated with an oil rotary pump and an oil diffusion pump, and then Ar is injected thereinto. An evacuation valve and a release valve are mounted to the chamber, and an Ar pressure in the chamber can be adjusted to from 0.8 atm to 1.2 atm by setting operation pressures of the valves. In this example, the Ar pressure is 1.2 atm. The vacuum evacuation may be performed through use of a turbo molecular pump or a mechanical booster pump. In this example, the cavity of the water cooled copper crucible is circular and has a diameter of 35 mm, that is, has a sectional area S1 of 962 $mm^2$.

A pilot arc is generated between an electrode tip placed in a plasma torch and a tip portion of an external cylinder of the plasma torch. Next, discharge (pilot arc) is transferred between the plasma torch and the base material/water cooled copper crucible by switching a DC power source from a pilot system to a main system, to thereby generate a plasma arc column. At this time, 15 L/min of Ar and 8 L/min of He are allowed to flow as a plasma source gas in the plasma torch. As described above, the combination of He, $N_2$, $H_2$, $CO_2$, or the like with Ar is also effective for increasing the energy density of the plasma arc. Further, the base material starts to be melted by increasing an output current up to about 600 A by the DC power source, and the output current is controlled so that a molten pool is formed in the cavity of the water cooled copper crucible. After the output current is increased up to about 850 A, the raw material bar is inserted in the plasma arc column at a constant speed by the raw material bar feeding mechanism, to thereby melt the raw material bar from its tip. Droplets of the raw material bar continuously fall on the molten pool. Therefore, the pulling down speed of the base material is adjusted (about 3 mm/min) by an ingot pulling down mechanism so that a constant liquid level height of the molten pool can be maintained. Continuous casting is performed while the raw material bar is appropriately added or exchanged.

As described above, a molten ingot having a diameter of about ϕ34.6 mm (S of 940 $mm^2$) and a length L of 500 mm or more with a smooth casting surface is obtained.

(Forging Step)

The molten ingot is evenly cut into a length of 150 mm or more. Appropriate cutting means is applicable to the cutting, but thin cutting grinding stone (diamond or other grinding materials), or wire discharge and a wire saw are effective in order to place emphasis on a material yield. The cut ingot is subjected to hot forging through heating to from 1,200° C. to 1,800° C. Forging axes are set to two axes (side surfaces) perpendicular to the center line of the columnar ingot, and the ingot is beaten in a center line direction to produce a rectangular bar. When a sectional area reduction rate of a surface of the columnar ingot perpendicular to the center line is set to 30% or more, fine crystal grains can be achieved. An upper limit of the sectional area reduction rate does not need to be particularly set, but 50% or less suffices.

When the forging is performed as described above, coarse crystal grains of the molten ingot can be sufficiently fined, which can facilitate subsequent rolling and wire drawing processing. In addition, the molten ingot has a smooth surface, and hence also the rectangular bar has a smooth surface.

(Rolling Step)

The surface of the rectangular bar is thinly ground through use of a belt grinding machine, a grinder, or the like in order to remove an adhering material, such as iron, derived from a forging machine. Next, the rectangular bar is subjected to hot rolling through heating to from 1,000° C. to 1,400° C. with a grooved roller a plurality of times to produce a rectangular wire having a substantially square shape. The heating is desirably performed through use of a tubular electric furnace or a continuous gas burner and a high-frequency heating furnace. At this time, when a sectional surface reduction rate in one processing is set to 20% or less, preferably 15% or less, generation of defects, such as cracks, can be suppressed.

When the processing is performed while the heating temperature is reduced in a stepwise fashion within the above-mentioned range, grain growth caused by recrystallization is suppressed, and a fiber structure can be formed and maintained. As a result, the processing can be performed without causing defects, such as cracks.

(Wire Drawing Step)

The rectangular wire is processed into a round wire of 0.4 mm by hot die wire drawing. A material heating temperature is set to fall within a range of from 900° C. to 1,300° C., and a heating method is similar to that in the rolling. At this time, when a sectional surface reduction rate in one processing is set to 10% or less, preferably 5% or less, generation of defects, such as cracks, can be suppressed.

(Cutting Step)

The round wire is cut into lengths suitable for a wire saw. A plurality of wires are overlapped so as to be in parallel with one another, fixed with a resin, and are cut by the wire saw, to thereby obtain electrode tips for a spark plug each having ϕ0.4×L0.6 mm.

EXAMPLES

Further description is given using Examples. Experimental conditions in Examples and Comparative Examples are shown in Table 1, experimental results of Examples and Comparative Examples are shown in Table 2, and evaluation of the results is shown in Table 3.

TABLE 1

Experimental conditions in Examples and Comparative Examples

| | Cavity dimensions | | Output | Composition of melting raw material | |
|---|---|---|---|---|---|
| No. | Diameter, mm | Area S1, $mm^2$ | current A | mass % | Balance |
| Example 1 | 27.5 | 594 | 800 | 20Ni | Pt |
| Example 2 | 30 | 707 | 850 | 5Pt | Ir |
| Example 3 | 35 | 962 | 810 | 20Ir5Ni | Pt |
| Example 4 | 35 | 962 | 850 | 10Rh1Ni | Ir |
| Example 5 | 40 | 1,257 | 850 | 10Pd | Pt |
| Example 6 | 50 | 1,963 | 900 | 20Ni | Pt |
| Comparative Example 1 | 25 | 491 | 820 | 5Pt | Ir |
| Comparative Example 2 | Non-consumable electrode-type arc melting method | | | 20Ni | Pt |
| Comparative Example 3 | Induction heating melting method | | | 10Pd | Pt |
| Comparative Example 4 | Vacuum plasma melting method | | | 10Rh | Ir |

TABLE 2

Experimental results in Examples and Comparative Examples

| No. | Atmosphere in chamber Pressure, atm | Atmosphere in chamber Gas L/min | Pulling down speed mm/min | Molten ingot dimensions Diameter, mm | Molten ingot dimensions Area S, $mm^2$ | Molten ingot dimensions Length L, mm |
|---|---|---|---|---|---|---|
| Example 1 | 1.2 | 15Ar | 7 | 27.2 | 581 | 305 |
| Example 2 | 1 | 15Ar | 5 | 29.7 | 693 | 185 |
| Example 3 | 0.8 | 23Ar | 4 | 34.6 | 940 | 160 |
| Example 4 | 1.2 | 15Ar8He | 3 | 34.6 | 940 | 155 |
| Example 5 | 1 | 15Ar8He | 3 | 39.5 | 1,225 | 125 |
| Example 6 | 1.2 | 15Ar8He | 2 | 49.6 | 1,932 | 125 |
| Comparative Example 1 | 1 | 15Ar8He | 7 | 24.7 | 479 | 283 |
| Comparative Example 2 | Non-consumable electrode-type arc melting method | | | | | |
| Comparative Example 3 | Induction heating melting method | | | | | |
| Comparative Example 4 | Vacuum plasma melting method | | | 24.7 | 479 | 105 |

(Production of Raw Material Bar)

In Examples 1, 3, 5 and 6, a raw material was melted in a zirconia crucible by a high-frequency induction melting method, and the crucible was inclined to pour (cast) the raw material into a water cooled copper casting mold. Thus, a molten ingot was produced. The molten ingot was subjected to removal processing of surface defects and the like, and formed into a rectangular bar through hot forging and groove rolling processing to produce a raw material bar.

In Example 2 and Comparative Example 1, raw material powders were mixed, and then formed into a rectangular parallelepiped measuring about 15 mm×about 15 mm×about 50 mm with a press forming machine and sintered at 1,500° C. for 3 h in an electric furnace in which an atmosphere was replaced with an Ar atmosphere. The resultant sintered articles were welded in a longitudinal direction with a TIG welding machine to produce a raw material bar (about 13 mm×about 13 mm×about 390 mm). In Example 4 and Comparative Example 4, formed articles of a rectangular parallelepiped measuring about 20 mm×about 20 mm×about 50 mm were formed by changing a press forming mold, sintered on the same conditions, and then welded in a longitudinal direction with a TIG welding machine to produce a raw material bar (about 17 mm×about 17 mm×about 390 mm).

In Comparative Examples 2 and 3, a raw material bar was not used. An alloy plate having a thickness of about 3 mm was cut into a size with which the alloy plate fitted in a crucible, and was used as a melting raw material.

(Production of Molten Ingot)

In Examples 1 to 6 and Comparative Example 1, the raw material bar was held in a horizontal direction by a raw material bar feeding mechanism of an atmospheric pressure plasma arc melting furnace. A small piece having the same composition as the raw material bar was placed as a base material on a plug arranged at a bottom part of a water cooled copper crucible having a through cavity. Next, a chamber of the melting furnace was vacuum evacuated with an oil rotary pump and an oil diffusion pump, and then Ar was injected thereinto. During melting, the internal pressure of the chamber was adjusted to a constant value by setting a vacuum evacuation valve and a release valve.

Further, Ar was allowed to flow as a plasma source gas in a plasma torch to generate a pilot arc, and then the plasma arc was transferred to the water cooled copper crucible and the base material. The base material started to be melted while increasing an output current, to thereby form a molten pool. After that, the raw material bar started to be melted by being inserted in a plasma arc column at a constant speed by the feeding mechanism, and its droplets were caused to fall on the molten pool. In order to maintain a constant liquid level height of the molten pool, the pulling down speed of the base material was adjusted by an ingot pulling down mechanism. Thus, continuous casting was performed. In the final stage, the molten pool was gradually solidified while reducing the output current. Thus, generation of a shrinkage cavity was suppressed.

Melting was continued by exchanging a shortened raw material bar for a new raw material bar.

In Examples 1 to 6, a uniformly molten and solidified state was able to be maintained while appropriately controlling the output current and the pulling down speed depending on the material or the area of the cavity. A contact surface (casting surface) of the molten ingot with the cavity had slight irregularities but was smooth, and in each of Examples, a long ingot was obtained.

A melting amount was limited in Examples, but when melting is continued, along ingot of 500 mm or more can be produced because the length of the molten ingot depends only on a pulling down allowance.

Meanwhile, in Comparative Example 1, solidification was visually observed intermittently on an outer peripheral portion of the cavity and it was difficult to maintain a uniformly molten and solidified state, while the molten pool was able to be formed. On the casting surface of the molten ingot, many deep wrinkles of more than 3 mm were present, and it was confirmed that the molten ingot was unsuitable for subsequent processing owing to difficult removal processing of such winkles.

The weight of the molten ingot of Examples 1 to 6 and Comparative Example 1 was measured, and as a result, it was found that a weight reduction amount was 1% or less. A material yield after cutting the plug from the molten ingot was 98% or more and was significantly high. The cut surface was quantitatively determined by fluorescence X-ray analysis, and as a result, a compositional variation beyond an analysis error was not confirmed.

In Comparative Example 2, anon-consumable arc melting method, which had hitherto been used, was employed. A molten ingot was produced by placing the alloy plate (raw material) of about 2 kg on a boat-shaped water cooled copper crucible, and vacuum evacuating a chamber and then providing the chamber with an Ar atmosphere of 0.7 atm. In order to completely melt the entirety of the raw material, the raw material was turned upside down and melted twice per one surface. An electrode made of tungsten was increasingly consumed during melting, and in the final stage, wandering of an arc column was observed. A discharge end of the electrode was observed after melting, and as a result, it was found that a pointed end portion was rounded and an adhering material adhered thereto. Therefore, it was confirmed that mass melting of more than 2 kg was not able to be performed by the non-consumable electrode-type arc melting method. The external shape of the molten ingot had a burr-shaped protrusion on a side surface. The weight of the molten ingot was measured after removal processing (grinding) of the protrusion, and as a result, it was found that the weight was reduced by 5% or more and a material yield was 94%. In addition, the molten ingot was cut and the cut surface was quantitatively determined by fluorescence X-ray analysis, and as a result, a compositional variation of about 0.3 mass % (Ni reduction) was confirmed.

In Comparative Example 3, the alloy plate of about 2 kg was loaded into a zirconia crucible, and was subjected to induction heating melting after a chamber of a melting furnace was vacuum evacuated and then provided with an Ar atmosphere of 0.9 atm. After confirmation of complete melting, the crucible was inclined to pour and cast the alloy into a mold. On an upper surface of a molten ingot, a casting defect owing to solidification shrinkage (a so-called shrinkage cavity) was confirmed. Therefore, a shrinkage cavity portion was subjected to removal processing (cutting). A contact surface with a casting wall (casting surface) had wrinkle-like irregularities. When the casting surface was trimmed (by a depth of about 0.5 mm), small pores and refractory were included, and therefore, the entirety of the casting surface was subjected to removal processing (trimming) by a depth of about 2 mm. The weight of the ingot after the removal processing was measured, and as a result, it was found that a material yield was 70% or less. Therefore, it was confirmed that a reduction in material yield was inevitable in an induction heating melting method. In addition, while the entirety of the surface was subjected to removal processing, there remained a risk in that defects, such as small pores and refractory, were included in the rest of the ingot. The trimmed surface was quantitatively determined by fluorescence X-ray analysis, and as a result, a compositional variation beyond an analysis error was not confirmed.

In Comparative Example 4, the raw material bar was held in a horizontal direction by a raw material bar feeding mechanism of a vacuum plasma melting furnace. A small piece having the same composition as the raw material bar was placed as a base material on a plug arranged at a bottom part of a water cooled copper crucible having a through cavity (ϕ50 mm).

Next, a chamber of the melting furnace was vacuum evacuated with an oil rotary pump and an oil diffusion pump.

Further, Ar was allowed to flow as a plasma source gas in a hollow cathode to generate a plasma beam, and after heating, the plasma beam was transferred to the water cooled copper crucible and the base material. The base material was melted while increasing an output current, to thereby form a molten pool. After that, the raw material bar started to be melted by being inserted in the plasma beam at a constant speed by the feeding mechanism, and its droplets were caused to fall on the molten pool. In order to maintain a constant liquid level height of the molten pool, the pulling down speed of the base material was adjusted by a pulling down mechanism. Thus, continuous casting was performed. During melting, a vacuum of 1.5 Pa was maintained while controlling the flow rate of Ar.

Melting was continued by exchanging a shortened raw material bar for a new raw material bar.

In Comparative Example 4, a uniformly molten and solidified state was able to be maintained while controlling the output current, the flow rate of the source gas, and the pulling down speed. As in Examples 1 to 6, a contact surface (casting surface) of a molten ingot with the cavity had slight irregularities but was smooth, and a long ingot having a length of about 105 mm was obtained. The weight of the molten ingot was measured, and as a result, it was found that a reduction amount was 2% or less, and a material yield after cutting the plug was as high as 96% or more. The cut surface was quantitatively determined by fluorescence X-ray analysis, and as a result, a compositional variation of 1 mass % (Rh reduction) was confirmed.

As described above, a vacuum plasma melting method was unsuitable for production of a homogeneous molten ingot because a compositional variation caused by vaporization of an alloy component having a high vapor pressure was remarkable, while a long ingot having a sound appearance was obtained.

(Evaluation of Results)

The evaluation shown in Table 3 is based on the following criteria.

A possibility of the molten ingot for an increase in size was evaluated as follows: the case in which an increase in size was not achieved was evaluated as "x", and the case in which an increase in size was achieved by a continuous casting system or by increasing the size of the crucible was evaluated as "○". The case in which a casting surface state was poor and significant removal processing was required was evaluated as "x", the case in which partial removal processing was required was evaluated as "Δ", and the case in which the casting surface state was almost smooth and removal processing was not required was evaluated as "○". The material yield was evaluated as follows: the case in which a ratio of a mass after melting and removal processing to a mass before the melting was less than 90% was evaluated as "x", the case in which the ratio was 90% or more was evaluated as "Δ", and of those, the case in which the ratio was 95% or more was evaluated as "○". The molten ingots in a poor casting surface state required removal processing and had a significant reduction in material yield. The compositional variation was evaluated as follows: the case in which a variation range was beyond the analysis error was evaluated as "x", and the case in which the variation range was within the analysis error was evaluated as "○".

In Examples of the present invention, all evaluation items were good (○), and the effects of the present invention were able to be confirmed.

TABLE 3

Evaluation results of Examples and Comparative Examples

| No . | Increase in size | Casting surface state | Material yield | Compositional variation |
|---|---|---|---|---|
| Example 1 | ○ | ○ | ○ | ○ |
| Example 2 | ○ | ○ | ○ | ○ |
| Example 3 | ○ | ○ | ○ | ○ |
| Example 4 | ○ | ○ | ○ | ○ |
| Example 5 | ○ | ○ | ○ | ○ |
| Example 6 | ○ | ○ | ○ | ○ |
| Comparative Example 1 | x | x | x | ○ |
| Comparative Example 2 | x | Δ | Δ | x |
| Comparative Example 3 | ○ | x | x | ○ |
| Comparative Example 4 | ○ | ○ | ○ | x |

From the above-mentioned results, it was revealed that, according to the present invention, a large molten ingot with no compositional variation was obtained at high material yield in production of a platinum group-based alloy.

The invention claimed is:

1. A method for producing a platinum group-based alloy, the method comprising a molten ingot production step of a continuous casting system using a plasma arc melting furnace configured to form a plasma arc column between an electrode torch which is arranged in an upper part of a vacuum chamber and a water cooled copper crucible which is arranged in a lower part of the chamber and has a cavity having a sectional area S1, the molten ingot production step comprising:

inserting and melting an end part of a raw material bar comprising a platinum group-based alloy in the plasma arc column to cause the raw material bar to fall in drops on a base material in the water cooled copper crucible, to thereby form a molten pool; and solidifying a bottom part of the molten pool while maintaining a constant liquid level height of the molten pool by pulling down the base material, the molten ingot having a horizontal sectional area S and a length L satisfying the following relationship:

$$S1 \geq S > 500\ (\mathrm{mm}^2),\ L > 4\sqrt{(S/\pi)}\ (\mathrm{mm}),$$

an internal pressure of the chamber during melting being 0.8 atm or more, a pulling down speed of the base material being 10 mm/min or less.

2. A method for producing a platinum group-based alloy according to claim 1, wherein:

the platinum group-based alloy contains 50 mass % or more of any one or more kinds of platinum group metals (Pt, Pd, Rh, Ir, Ru, Os) and 0.5 mass % or less of inevitable impurities; and a difference between maximum and minimum values of vapor pressures of component elements of the platinum group-based alloy is 0.1 Pa or more at a melting point of a component element having the highest melting point of the component elements.

* * * * *